US005636571A

United States Patent [19]

Abrahamson

[11] Patent Number: 5,636,571

[45] Date of Patent: Jun. 10, 1997

[54] SYSTEM FOR CLEANING PRINTING PRESS ROLLER ASSEMBLIES

[75] Inventor: Dean W. Abrahamson, Yorkville, Ill.

[73] Assignee: Sonic Solutions, Inc., Yorkville, Ill.

[21] Appl. No.: 548,080

[22] Filed: Oct. 25, 1995

[51] Int. Cl.[6] ..... B41F 35/00

[52] U.S. Cl. ..... 101/424; 101/425; 134/159; 134/149

[58] Field of Search ..... 101/424, 423, 101/425; 15/256.51; 134/159, 149, 158, 157, 165

[56] References Cited

U.S. PATENT DOCUMENTS

| | | | |
|---|---|---|---|
| 2,239,904 | 4/1941 | Soderberg | 134/159 |
| 3,040,754 | 6/1962 | Lear | 134/147 |
| 3,083,719 | 4/1963 | Herrling | 134/157 |
| 3,145,510 | 8/1964 | Mayer et al. | 134/159 |
| 3,679,681 | 7/1972 | Habermeier et al. | 260/256.4 |
| 4,178,091 | 12/1979 | Solomon | 134/159 |
| 4,447,580 | 5/1984 | Ai et al. | 525/121 |
| 5,291,827 | 3/1994 | Liers | 101/424 |

*Primary Examiner*—Edgar S. Burr
*Assistant Examiner*—Anthony H. Nguyen
*Attorney, Agent, or Firm*—John L. Schmitt

[57] ABSTRACT

A system particularly adapted for cleaning ink residue from cells forming part of an outer surface of a ceramic inking roll of a printing press roller assembly includes an ultrasonic tank unit. Seated on an top open end of the tank unit is a drive mechanism comprising a set of spaced apart wheels operatively connected to a motor by a belt. As fitted over the wheels, the belt engages one end of a shaft of the ink roller assembly. An opposite end of the shaft then is held by a set of wheels of an idle mechanism also seated on the tank unit top end. For use the tank unit is filled with a cleaning solution so that about a bottom one-third of the roll outer surface submerges in the solution, and the shaft and any included bearings or gears on the shaft remain free from contact with the solution. As the motor drives the belt to slowly turn the roll through the cleaning solution, sonic energy from a generator in the tank unit forces solution into the roll cells to incrementally scrub out the imbedded ink residue. As residue is removed, the surface of the roll changes from a shinny-dark to a uniform dull-light appearance indicating that cleaning is complete.

12 Claims, 3 Drawing Sheets

SYSTEM FOR CLEANING PRINTING PRESS ROLLER ASSEMBLIES

BACKGROUND OF THE INVENTION

1. Field of the Invention

This invention relates to cleaning systems and more particularly to a system adapted for removing ink residue imbedded in laser formed cells of ceramic inking rolls used in printing presses.

2. Prior Art

Systems for cleaning rolls of roller assemblies have been known and in use for many years.

One early system particularly adapted for cleaning rolls used for processing photographic film is set out in U.S. Pat. No. 3,503,805. This system includes a cabinet for a rinse tank and a cleaning liquid tank fitted with several ultrasound units. For cleaning, the rolls are placed between a pair of spaced apart vertical plates of a hoist mechanism selectively located in the cleaning tank. The rolls operatively connect with a series of drive sprockets carried by one of the plates so that the rolls rotate continuously during cleaning. After completion of a short cleaning cycle, the hoist mechanism is used to transfer the rolls to the rise tank for a water spray.

A more modern printing cylinder cleaning system is disclosed in three related patents, U.S. Pat. Nos. 5,058,611, 5,240,506, and 5,291,827. This system includes a heatable tank preferably filled with a biodegradable cleaning solution. Along sidewalls and a bottom of the tank is a series of ultrasonic generating units for producing a 2,400 watt output in a frequency range of 25–29 kHz. For use a cylinder is lowered into the tank so that its shaft ends seat respectively on a pair of rollers of a rotation mechanism positioned on the tank bottom. As the cylinder rotates at a low rpm, ink residue in cells of the cylinder is softened by the heated cleaning solution and then cavitated from these cells by ultrasonic energy. The original system subsequently was improved by adding means for adjusting the vertical height of the rotation mechanism.

A still further printing cylinder cleaning system is disclosed in U.S. Pat. No. 5,069,125 and includes a device for dispensing a cleaning cloth from a supply roll. The cloth may be a composition material of synthetic fibers, natural fibers and wood pulp and is pre-impregnated with a cleaning liquid such as diethylene glycol and polyethylene glycol. To prevent the cleaning liquid from evaporating, the supply roll is kept in a sealed container until ready for use. To clean a printing machine cylinder the cloth feeds from the roll to press against and remove ink from the cylinder and then reaccumulates on a take-up roll.

SUMMARY OF THE INVENTION

The system of this invention is particularly adapted for cleaning ink residue imbedded in cells of ceramic inking rolls of printing press roller assemblies. The system includes an ultrasonic tank unit filled with a cleaning solution. Fitted on a top edge of one end wail of the tank unit is a drive mechanism comprising a pair of spaced apart wheels operatively connected to a motor by a belt. As fitting over the wheels, the belt is prepared to carry one end of a shaft of the roller assembly.

The system further includes an idle mechanism adjustably carried by sidewalls of the tank for selective positioning of the idle mechanism from the drive mechanism. The idle mechanism has a like pair of spaced apart wheels prepared to carry an opposite end of the assembly shaft.

For use one end of a shaft of a roller assembly having a roll to be cleaned is positioned on the drive mechanism belt. With the idle mechanism then selectively positioned, the other shaft end is located on the idle mechanism wheels. As positioned, only a bottom segment of the roll outer surface is submerged in the cleaning solution. If the assembly includes a bearing, gear, or both, these components are located either outside of the tank or have a sufficiently small diameter to locate above the cleaning solution.

The drive mechanism and the ultrasonic generator then are energized so that the roll slowly rotates through the cleaning solution in the tank. Wave energy from the generator forces the solution into cells of the roll to incrementally scrub imbedded ink residue therefrom, As cleaning progresses, an appearance of the outer surface the roll changes from shinny-dark to one that is dull-light. When the entire roll outer surface has a uniform, dull-light appearance, cleaning is complete. The assembly then is removed from the tank unit, rinsed with water, dried, and returned to service.

The printing roller assembly cleaning system of this invention provides several advantages over other systems known or in use.

To appreciate a first advantage it must be understood that today many printing roller assemblies include bearings, gears, or both integrally joined to the assembly shaft. Were such components to come into contact with the cleaning solution, they would be damaged. Therefore, before a full-submersion cleaning these components are removed from the shaft and then reassembled to the shaft when the roll is clean. Performance of these tasks not only requires a labor input, but special skills and tooling also may be needed. Because this inventive system uses only partial submersion, any included assembly bearings, gears, or both remain free from cleaning solution contact. Thus, there is no need for disassembly and reassembly of any such components.

A second advantage is that this system reduces operator risk of injury. While an operator still must wear protective equipment, the operator is not required to reach into a tank filled with a heated corrosive cleaning solution to first locate the assembly for cleaning and then to remove the assembly when cleaning is complete. Additionally, no hoist or other mechanical means is needed for roller assembly handling.

A third advantage is that the drive and idle mechanism of the system may be readily removed from the tank unit. Thus, the operator has unobstructed access to the tank of the tank unit for filling, cleaning, or any other tank maintenance. When these functions are complete, the drive and idle mechanism are easily repositioned on the tank unit.

A still further advantage is that the roll of the roller assembly remains in view during cleaning, As may be appreciated, removed ink residue quickly transforms fresh, clear cleaning solution into one so murky that a submerged roll cannot be seen. Theretofore, the operator had to stop operation of the system and remove the submerged roller assembly from the tank to determine if cleaning were complete. If not complete, then the assembly must be resubmerged in the tank and the system restarted. This inventive system allows the operator to determine when cleaning is complete by simply observing the roll. Note also that minimizing roller assembly handling is important since ceramic rolls chip easily.

A last advantage is that this system may be readily adjusted to accommodate different length roller assemblies and roller assemblies having different diameter rolls. Adaptability is particularly valuable for larger printing operations having different printing presses which utilize different roller assemblies. This adjustability includes cleaning the rolls of two like roller assemblies or the rolls of two different roller assemblies at one time.

DESCRIPTION THE PREFERRED EMBODIMENT

Figure 1:
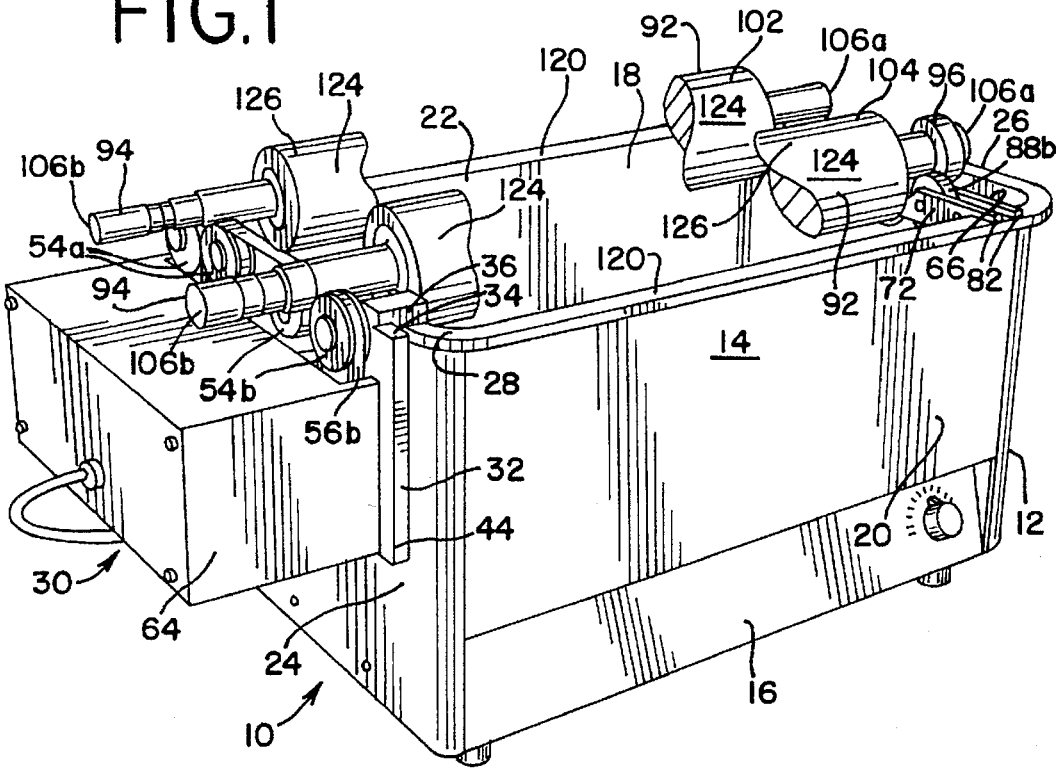
FIG. 1 is a perspective view of the system of this invention for cleaning inking rolls of printing press roller assemblies. As shown, a tank of a tank unit of the system is empty.

A system for cleaning ink residue from cells of ceramic inking rolls of printing press roller assemblies is shown generally in FIG. 1 and designated 10. In the trade such rolls often are referred to as anilox rolls. To simplify description of the system 10, like reference numbers may be used to identify like structure of the system 10.

The system 10 includes an ultrasonic tank unit 12 having an open top end tank 14 and ultrasonic generator (not shown) in a lower portion 16 of the tank unit 12. Additionally, the tank unit 12 may include a heating element (not shown). A number of ultrasonic tank units are commercially available, the preferred unit 12 being a Model Q6-50 from L & R Manufacturing Co. of Kerny, N.J. An interior space 18 of the tank 14 is defined by spaced apart sidewalls 20, 22 which are connected by a first and a second end wall 24, 26. The size of the tank interior space 18 is approximately 20 in. long, 12 in. wide, and 7 in. deep.

Figure 2:
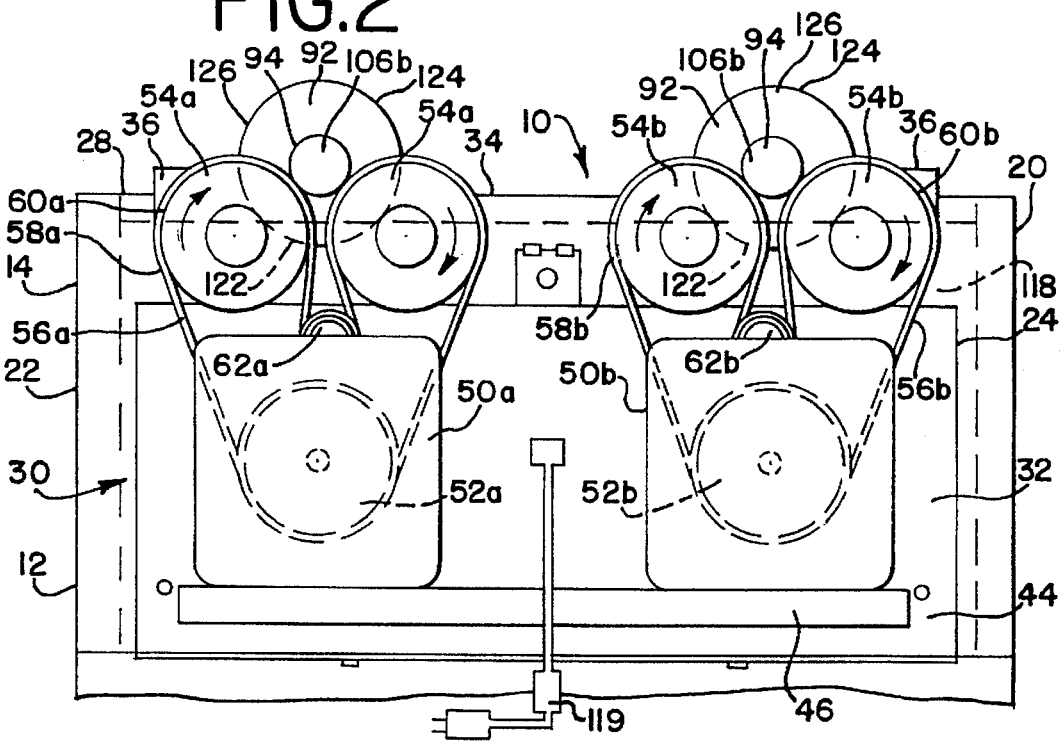
FIG. 2 is a partial end elevation view of the system of FIG. 1 showing a coverless drive mechanism of the system.
Figure 3:
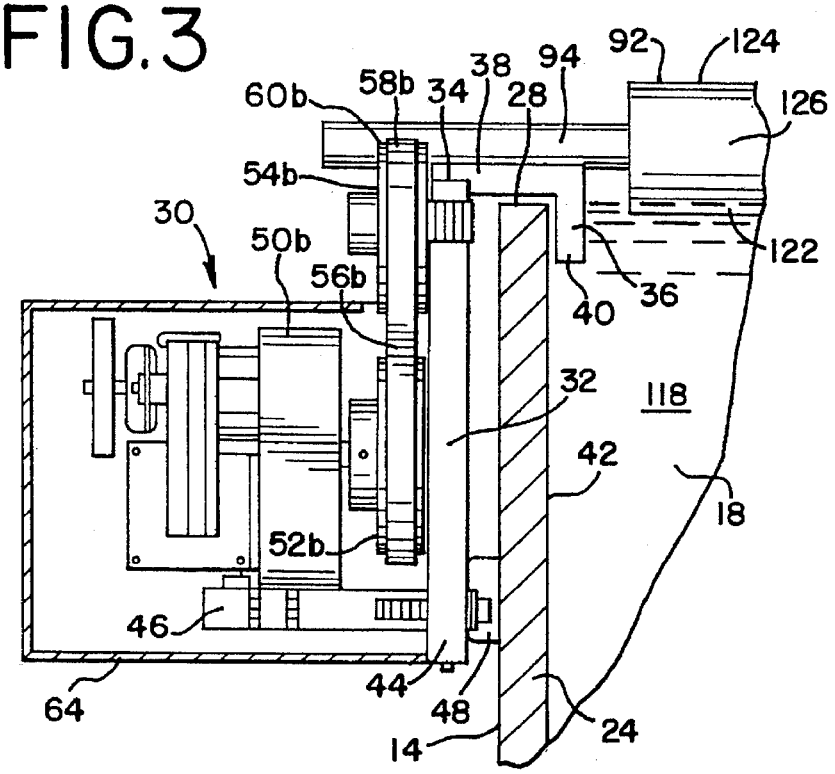
FIG. 3 is a partial side elevation view in section as seen generally alone the line 3—3 in FIG. 4A.

As best seen in FIGS. 1–3, carried on a top edge 28 of the tank end wall 24 is a roller assembly drive mechanism 30. This drive mechanism 30 includes a vertical support plate 32 having an upper edge 34 fitted with two spaced apart angle brackets 36. As shown in FIG. 3, each bracket 36 has a horizontal leg 38 that rests on the tank end wall top edge 28 and a downward extending vertical leg 40 that fits against an inner side 42 of the tank first end wail 24. Projecting outwardly from and attached to a lower portion 44 of the support plate 32 is a horizontal platform 46. A pair of inward extending spacers 48 attached to the support plate 32 interact with the tank first end wall 24 to maintain the orientation of the drive mechanism 30.

The platform 46 forms a support for a pair of spaced apart, gear-reduced, low rpm electric motors 50*a*, 50*b*. On a drive shaft of each motor 50*a*, 50*b* is a drive sprocket 52*a*, 52*b*. Located above and on each side of each drive sprocket 52*a*, 52*b* is a pair of spaced apart drive wheels 54*a*, 54*b* which are rotatively carried on shafts affixed to the vertical support plate 32. Each set of drive sprockets and drive wheels 52*a*–54*a*, 52*b*–54*b* is operatively connected by a respective a timing belt 56*a* and 56*b*. As best seen in FIG. 3, an outer side 58*a*, 58*b* of each timing belt 56*a*, 56*b* extends beyond outer side edges 60*a*, 60*b* of the drive wheels 54*a*, 54*b*. Additionally, each belt 56*a*, 56*b* loops under a respective idle pulley 62*a*, 62*b* rotatively carried on a further shaft affixed to the vertical support plate 32. Each idle pulley 62*a*, 62*b* is located between and below its respective pair of drive wheels 54*a*, 54*b*. For operator protection the drive mechanism 30 includes a removable cover 64.

Figure 5:
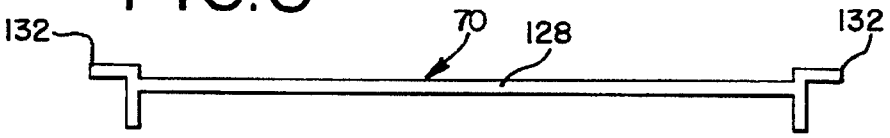
FIG. 5 is an elevation view of an optional center support of the system.
Figure 6:
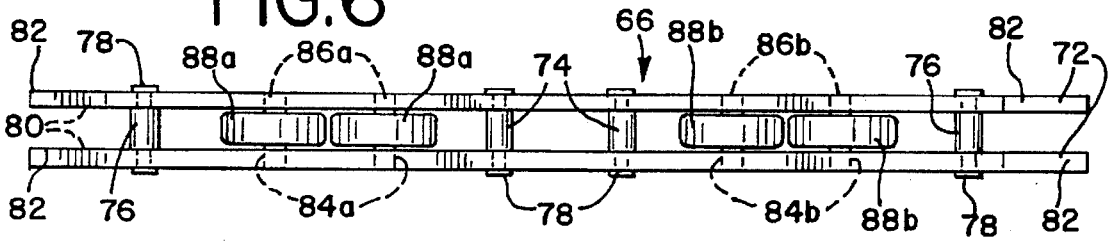
FIG. 6 is a plan view of a full-width idle mechanism of the system.
Figure 7:
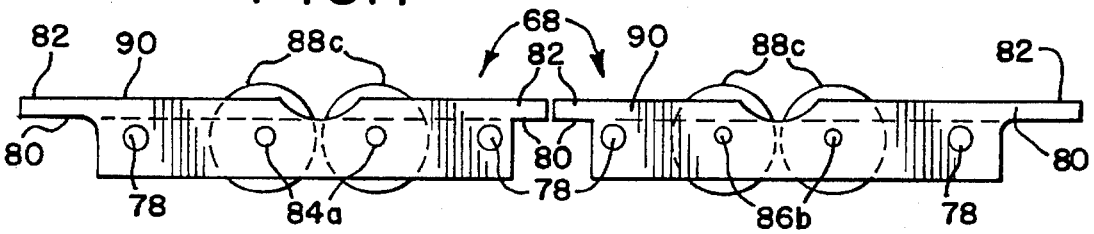
FIG. 7 is a side elevation view of a pair of split-width idle mechanisms of the system.

The system 10 further includes an idle mechanism available in two configurations. A full-width idle mechanism 66 is seen in FIGS. 1 and 6. A pair of split-width idle mechanisms 68 is set out in FIGS. 4, 4A, and 7. The split-width mechanism 68 is used with a center support 70 shown in detail in FIG. 5 and described below.

The full-width idle mechanism 66 is defined by a pair of bars 72 spaced apart by a set of inner sleeves 74 and a set of outer sleeves 76. The bars 72 and sleeves 74, 76 then are joined together by fasteners 78. End notches 80 formed in each bar 72 define pairs of horizontal leg extensions 82.

In each bar 72 between the inner sleeves 74 and the outer sleeves 76 are two pairs of openings 84*a*, 84*b* for disposition of ends of pairs of shafts 86*a*, 86*b*. Positioned between the bars 72 and rotatively carried on the pairs of shafts 86*a*, 86*b* are respective pairs of spaced apart idle wheels 88*a*, 88*b*.

The split-width idle mechanism 68 is much like the full-width mechanism 66 except its end notched bars 90 are slightly less than one-half the length of the bars 72, and the split-width mechanism 68 has only one pair of idle wheels 88*c*.

The system 10 is structured to clean anilox inking rolls 92 of several different printing press roller assemblies. A roller assembly is defined by whether that assembly includes a shaft 94, a bearing or pair of bearings 96, a gear 98, a partial shaft 100 or just the roll 92.

For example, FIG. 1 shows two roller assemblies 102 and 104. The first roller assembly 102 comprising a roll 92 and a shaft 94. The second roller assembly 104 in FIG. 1 includes a roll 92, a shaft 94, and a bearing 96 attached to one end 106*a* of the shaft 94.

Figure 4:
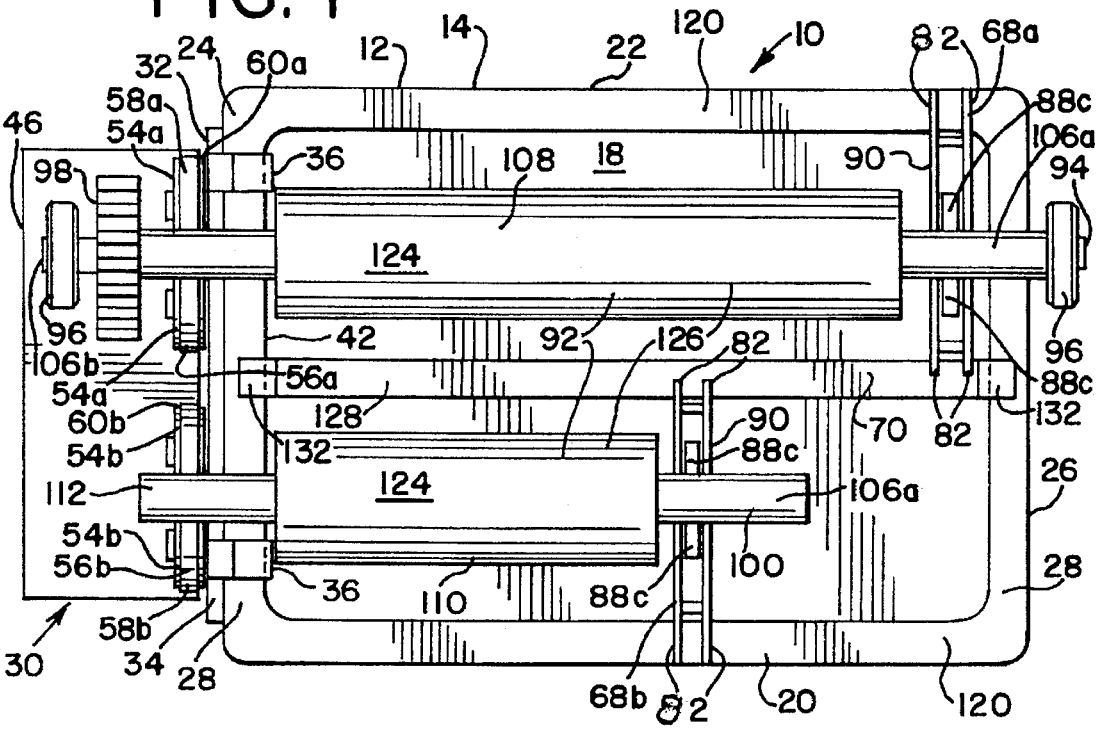
FIG. 4 is a plan view of the system of FIG. 1 configured to clean rolls of two different roller assemblies.

FIG. 4 shows a third roller assembly 108 having a roll 92, a shaft 94, two bearings 96 on respective ends 106*a*, 106*b* of the shaft 94, and a gear 98 also on the shaft end 106*b*. A fourth roller assembly 110, also shown in FIG. 4, comprises a roll 92 and a partial shaft 100. For cleaning purposes the other end of the roll 92 of the roller assembly 110 is mounted on a dowel rod 112 which may have a uniform diameter or be tapered.

Figure 4A:
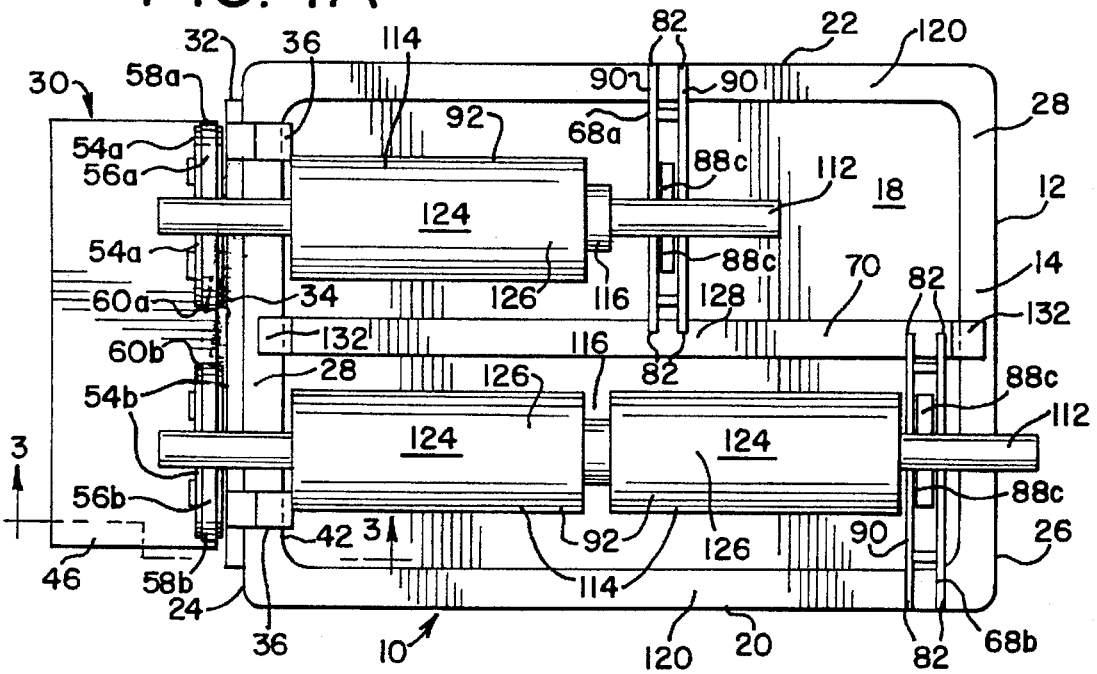
FIG. 4A is a plan view showing the system configured to clean rolls of still further different roller assemblies.

Lastly in FIG. 4A, three like roller assemblies 114 are shown. In this case each assembly 114 is simply a roll 92 mounted for cleaning on a dowel rod 112 where the roll 92 is held in place by a collar at 116. Note that where a length of the roll 92 is less than one-half the length of the tank interior space 18, it is possible to mount two rolls 92 on one dowel rod 112 where the rolls 92 are spaced apart by a collar 116.

To prepare the system 10 of FIG. 1 for cleaning, the tank 14 of the tank unit 12 is filled with a cleaning solution 118, see FIG. 3. The preferred solution 118 includes anhydrous sodium hydroxide, ethylene glycol monobutyl ester, and a small amount of monoethanolamine. Suppliers of the preferred solution include the assignee of this invention as well as CR Products, Inc. of Farmingdale, N.Y., which identifies its product as CR-1. If the cleaning solution 118 is not warm from system use, the heating unit in the tank unit 12 is activated to warm the solution 118 in the tank 14 to a temperature in a range of about 120 to 140 deg. F.

With the drive mechanism 30 supported from the tank end wall top edge 28, the motors 50*a*, 50*b* are connected through an off-on switch 119 to a source of electric power. The leg extensions 82 of the full-width idle mechanism 66 then are seated on respective top edges 120 of the tank sidewalls 20, 22. In this case, because the shafts 94 of the rollers assemblies 102, 104 are long, the idle mechanism 66 is located next to the second end wall 26. As the idle mechanism 66 is located, its pairs of wheels 88*a*, 88*b* longitudinally align with the drive mechanism pairs of wheels 54*a*, 54*b*.

Next the roller assemblies 102, 104 are placed in the tank interior space 18 such that the ends 106*b* of each shaft 94 may rested respectively on the belts 56*a*, 56*b* as these belts 56*a*, 56*b* fit over the drive wheels 54*a*, 54*b* of the drive mechanism 30. Lastly, the other ends 106*a* of the roller assembly shafts 94 are fitted on the wheels 88*a*, 88*b* of the idle mechanism 66. Note that while the bearing on the shaft 94 of the roller assembly 104 is not outside of the tank 14, the diameter of this bearing 96 is sufficiently small relative to a diameter of the roll 92 that the bearing 96 remains free from damaging contact with the cleaning solution 118.

As the roller assemblies 102, 104 are carried by the drive and idle mechanisms 30, 66, about a bottom one-third segment 122 of an outer surface 124 of each roll 92 submerges in the cleaning solution 118. A remaining upper segment 126 of the roll outer surface 124 locates above the solution 118 so that this upper segment 126 is readily visible.

The drive mechanism 30 then is energized so that the motors 50*a*, 50*b* drive the timing belts 56*a*, 56*b* to rotate the roller assemblies 102, 104 at about one rpm, Concurrently, the ultrasonic generator is activated to produce 42 khz. energy waves that force the cleaning solution 118 into the cells of the rolls 92 to scrub out ink residue entrapped therein.

As cleaning progresses, the outer surface 124 of each roll 92 slowly changes from a shinny-dark appearance to one which is dull and light. When the outer surface 124 of each roll 92 is uniformly dull-light, ink residue removal is complete. The system 10 then is de-energized; the roller assemblies 102, 104 are removed from the tank 14, water rinsed, and dried for selective return to printing press service.

Operation of the system 10 to clean ink residue from the rolls 92 of roller assemblies 108, 110 in FIG. 4 is similar to that described above. One difference is that the end 106*a* of the shaft 92 of the roller assembly 108 is carried on wheels 88*c* of a split-width idle mechanism 68*a*, and the end 106*a* of the partial shaft 100 of the roller assembly 110 is carried on wheels 88*c* of a second split-width idle mechanism 68*b*. In this case, one pair of leg extensions 82 of the bars 90 of each split-width idle mechanism 68*a*, 68*b* seats on a middle section 128 of the center support 70. On each end of the center support middle section 128 is an angle bracket 132. These angle brackets 132 then fit respectively on the top edge 28 of the tank end walls 24, 26. Note that the longitudinal location of the split-width idle mechanisms 68*a*, 68*b* has been adjusted to accommodate the particular length of the roller assemblies 108, 110 shown in FIG. 4. The system 10, as configured in FIG. 4A, is similar to that in FIG. 4.

While embodiments, uses and advantages of this invention have been shown and discussed, it should be understood that this invention is limited only by the scope of the claims. Those skilled in the art will appreciate that various modifications or changes may be made without departing from the scope and spirit of the invention, and these modifications and changes may result in further uses and advantages.

What I claim is:

1. A system particularly adapted for cleaning ink residue imbedded in cells of ceramic inking rolls of printing press roller assemblies in a tank unit, said tank unit having a generator of ultrasonic energy, a tank defined by spaced apart sidewalls connected by end walls with said walls having a top edge, and a cleaning solution in said tank, said system comprising:

a drive mechanism having support means for engaging said tank and positioning said drive mechanism next to one said tank end wall and having operative rotational means to engage one end of said roller assembly and position a bottom segment of an outer surface of said roller assembly roll a selective distance below said top edge of said tank walls of said tank unit and position an upper segment of said roll outer surface above said top edge of said tank walls for visual inspection from above said tank, and an idle mechanism having support means for engaging sidewalls of said tank to allow ready selective movement of said idle mechanism along the sidewalls of said tank and having rotational means to engage an opposite end of said roller assembly wherein during operation of said system said drive mechanism and said idle mechanism are carried by said tank, said roller assembly ends supported respectively by said drive mechanism and said idle mechanism, with only said roll bottom segment submerged in said cleaning solution, and said drive mechanism then activated to revolve said roller assembly so that said ultrasonic energy from said generator in said tank unit propels said cleaning solution into said roll bottom segment cells and scrubs out said imbedded ink residue until said roll outer surface upper segment is observed having a uniformly dull-light appearance indicating that cleaning is complete.

2. A system as defined by claim 1 and further characterized by, said drive mechanism including a pair of said operative rotational means positioned in a side-by-side relationship, and said idle mechanism including a pair of said rotational means positioned in a side-by-side relationship to longitudinally align respectively with said pair of said operative rotational means of said drive mechanism, wherein where one said roller assembly is carried by said one aligning drive mechanism operative rotational means and idle mechanism rotational means and another said roller assembly is carried by said other aligning drive mechanism operative rotational means and idle mechanism rotational means, two said roller assemblies are cleaned at one time by said system.

3. A system as defined by claim 1 and further characterized by said drive mechanism operative rotational means including, a motor carried by said support means and having a drive sprocket, a pair of drive wheels rotatively carried by said support means, said drive wheels spaced apart less than a diameter of said roller assembly end, an idle pulley rotatively carried by said support means to locate between said drive wheels, and an endless belt extending about a motor drive sprocket and said drive wheels and looping under said idle pulley, wherein during use said drive wheels provide in-line support of said roller assembly end to maintain said belt tension free from weight of said roller assembly as said motor drives said belt to rotate said drive wheels in a like direction.

4. A system particularly adapted for cleaning ink residue imbedded in cells of ceramic inking rolls of printing press roller assemblies in a tank unit, said tank unit having a generator of ultrasonic energy, a tank defined by spaced apart sidewalls connected by end walls with said walls having a top edge, and a cleaning solution in said tank, said system comprising:

a drive mechanism having operative rotational means to engage one end of said roller assembly and position a bottom segment of an outer surface of said roller assembly roll a selective distance below said top edge of said tank walls of said tank unit and position a remaining upper segment of said roll outer surface for visual inspection from above said tank, an idle mechanism having rotational means to engage an opposite end of said roller assembly and position said bottom segment of said outer surface of said roller assembly roll a selective distance below said top edge of said tank walls of said tank unit and position said remaining upper segment of said roll outer surface for visual inspection from above said tank, said drive mechanism operative rotational means including, support means, a motor carried by said support means and having a drive sprocket, a pair of spaced apart drive wheels rotatively carried by said support means, an idle pulley rotatively carried by said support means to locate between said drive wheels, an endless belt extending about said motor drive sprocket and said drive wheels and looping under said idle pulley, and said belt having an outer side extending beyond side edges of said drive wheels, wherein during operation of said system said drive mechanism and said idle mechanism are carried by said tank, said roller assembly ends supported respectively by said drive mechanism belt and said idle mechanism, said roll bottom segment submerged in said cleaning solution, and said drive mechanism then activated so that said motor drives said belt to rotate said drive wheels in a like direction and revolve said roller assembly so that said ultrasonic energy from said generator in said tank unit propels said cleaning solution into said roll bottom segment cells and scrubs out said imbedded ink residue until said roll outer surface upper segment is observed having a uniformly dull-light appearance indicating cleaning is complete.

5. A system particularly adapted for cleaning ink residue imbedded in cells of ceramic inking rolls of printing press roller assemblies in a tank unit, said tank unit having a generator of ultrasonic energy, a tank defined by spaced apart sidewalls connected by end walls with said walls having a top edge, and a cleaning solution in said tank, said system comprising:

a drive mechanism having operative rotational means to engage one end of said roller assembly and position a bottom segment of an outer surface of said roller assembly roll a selective distance below said top edge of said tank walls of said tank unit and position a remaining upper segment of said roll outer surface for visual inspect from above said tank, an idle mechanism having rotational means to engage an opposite end of said roller assembly and position said bottom segment of said outer surface of said roller assembly roll a selective distance below said top edge of said tank walls of said tank unit and position said remaining upper segment of said roll outer surface for visual inspection from above said tank, said drive mechanism operative rotational means including, support means motor carried by said support means and having a drive sprocket, a pair of spaced apart drive wheels rotatively carried by said support means, an idle pulley rotatively carried by said support means to locate between said drive wheels, an endless belt extending about said motor drive sprocket and said drive wheels and looping under said idle pulley, and said drive mechanism support means including, a vertical support plate providing said rotational support for said drive wheels and said idle pulley, angle brackets attached to said support plate, said brackets prepared to engage one said end wall of said tank for supporting said drive mechanism therefrom, a horizontal platform attached to and extending outward from said vertical support plate to carry said motor, and spacers attached to and extending inward from said vertical support plate, said spacers prepared to engage said tank end wall to maintain said drive mechanism in an operative orientation, wherein during operation of said system said drive mechanism and said idle mechanism are carried by said tank, said roller assembly ends supported respectively by said drive mechanism belt and said idle mechanism, said roll bottom segment submerged in said cleaning solution, and said drive mechanism then activated so that said motor drives said belt to rotate said drive wheels in a like direction and revolve said roller assembly so that said ultrasonic energy from said generator in said tank unit propels said cleaning solution into Said roll bottom segment cells and scrubs out said imbedded ink residue until said roll outer surface upper segment is observed having a uniformly dull-light appearance indicating cleaning is complete.

6. A system particularly adapted for cleaning ink residue imbedded in cells of ceramic inking rolls of printing press roller assemblies in a tank unit, said tank unit having a generator of ultrasonic energy, a tank defined by spaced apart sidewalls connected by ends wall with said walls having a top edge, and a cleaning solution in said tank, said system comprising:

a drive mechanism having operative rotational means to engage one end of said roller assembly and position a bottom segment of an outer surface of said roller assembly roll a selective distance below said top edge of said tank walls of said tank unit and position a remaining upper segment of said roll outer surface for visual inspect from above said tank, an idle mechanism having rotational means to engage an opposite end of said roller assembly and position said bottom segment of said outer surface of said roller assembly roll a selective distance below said top edge of said tank walls and position said remaining upper segment of said roll outer surface for visual inspection from above said tank, said idle mechanism including, a pair of plates spaced apart by sleeves, leg extensions formed on ends of said plates, said leg extensions prepared to connect with said tank for supporting said idle mechanism therefrom, and said idle mechanism rotational means defined by a pair of spaced apart idle wheels positioned between and carried by said plates, wherein during operation of said system said drive mechanism and said idle mechanism are carried by said tank, said roller assembly ends supported respectively by said drive mechanism and said idle mechanism, said roll bottom segment submerged in said cleaning solution, and said drive mechanism then activated to revolve said roller assembly so that said ultrasonic energy from said generator in said tank unit propels said cleaning solution into said roll bottom segment cells and scrubs out said imbedded ink residue until said roll outer surface upper segment is observed having a uniformly dull-light appearance indicating cleaning is complete.

7. A system as defined by claim 6 and further characterized by, said idle mechanism plates having a selective length for seating said plate leg extensions on said top edge of said sidewalls of said tank.

8. A system particularly adapted for cleaning ink residue imbedded in cells of ceramic inking rolls of printing press roller assemblies in a tank unit, said tank unit having a generator of ultrasonic energy, a tank defined by spaced apart sidewalls connected by end walls with said walls having a top edge, and a cleaning solution in said tank, said system comprising:

a drive mechanism having operative rotational means to engage one end of said roller assembly and position a bottom segment of an outer surface of said roller assembly roll a selective distance below said top edge of said tank walls of said tank unit and position a remaining upper segment of said roll outer surface for visual inspect from above said tank, an idle mechanism having rotational means to engage an opposite end of said roller assembly and position said bottom segment of said outer surface of said roller assembly roll a selective distance below said top edge of said tank walls and position said remaining upper segment of said roll outer surface for visual inspection from above said tank, said system including a center support defined by, a middle section, and angle brackets attached one each to ends of said center section, wherein during use of said system said drive mechanism and one end of said idle mechanism are carried by said tank, said center support angle brackets seat respectively on said end walls of said tank and an opposite end of said idle mechanism seats on said support member center support, said roller assembly ends are supported respectively by said drive mechanism and said idle mechanism, said roll bottom segment submerged in said cleaning solution, and said drive mechanism then activated to revolve said roller assembly so that said ultrasonic energy from said generator in said tank unit propels said cleaning solution into said roll bottom segment cells and scrubs out said imbedded ink residue until said roll outer surface upper segment is observed having a uniformly dull-light appearance indicating cleaning is complete.

9. A system for cleaning a printing press roller assembly having a shaft having a first and second end and a roll carried on said shaft between said first and second ends, said system comprising:

an ultrasonic tank unit having a tank defined by spaced apart sidewalls connected by end walls and filled with a cleaning solution, a drive mechanism carried by one said tank end wall, said drive mechanism having a set of drive wheels spaced apart a distance less than a diameter of said shaft, operative means, and a belt connecting said drive wheels to said operative means, said first end of said shaft of said roller assembly carried on said belt to locate a bottom segment of an outer surface of said roll of said roller assembly in said cleaning solution, locate a remaining upper segment of said roll outer surface above said cleaning solution, and locate any gear and bearing means on said shaft first end free from contact with said cleaning solution, and an idle mechanism having support means engaging said sidewalls of said tank for ready, selective movement of said idle mechanism along the top of said tank sidewalls, said idle mechanism having a set of freely rotational wheels spaced apart a distance less than a diameter of said roller assembly shaft second end, said shaft second end carried on said wheels to locate said roll outer surface bottom segment in said cleaning solution, locate said remaining upper segment of said roll outer surface above said cleaning solution, and locate any gear and bearing means on said shaft second end free from contact with said cleaning solution, wherein during cleaning said drive mechanism slowly rotates said roller assembly shaft so that said cleaning solution is forced by ultrasonic waves generated by said tank unit into cells of said roller assembly roll outer surface then passing through said solution to scrub bits of imbedded ink residue from said cells, and said cleaning continuing until substantially all said ink residue is removed from said cells as indicated by a readily observed change in appearance of said roll outer surface remaining upper segment.

10. A system as defined by claim 9 and further characterized by, said ultrasonic tank unit having heating unit means carried in a lower portion of said tank unit for heating said cleaning solution in said tank to a temperature in a range of about 120 to 140 deg. F., and ultrasonic generator means carried in said lower portion of said tank unit for producing ultrasonic energy at a frequency of about 42 kHz.

11. A system as defined by claim 9 and further characterized by said cleaning solution including, anhydrous sodium hydroxide, ethylene glycol monobutyl ester, and a small amount of monoethanolamine.

12. A method of cleaning ink residue from cells in an outer surface of a ceramic roll of a printing press roller assembly, said method comprising the steps of:

a. filling a tank of an ultrasonic tank unit with a cleaning solution, b. locating a drive mechanism next to one end of said tank and an idle mechanism at an opposite end of said tank, c. seating respective ends of said roller assembly on a belt of said drive mechanism and on a pair of wheels of said idle mechanism to submerge a bottom segment of an outer surface of said roll in said cleaning solution and locate a remaining upper segment of said outer surface of said roll above said cleaning solution, d. activating said drive mechanism to rotate said roller assembly, e. activating said ultrasonic tank unit to generate ultrasonic waves having a frequency of about 42 kHz that force said cleaning solution into said roll outer surface cells then in said cleaning solution to scrub out said imbedded ink therein, and f. observing during said rotation of said roller assembly a change in appearance of said upper segment of said roll outer surface from a dark-bright to a uniform dull-light to indicate that cleaning of said cells is complete.

* * * * *